US007731014B2

(12) United States Patent
Berdelle-Hilge et al.

(10) Patent No.: US 7,731,014 B2
(45) Date of Patent: Jun. 8, 2010

(54) DEVICE FOR CONVEYING A STACK OF FLAT OBJECTS

(75) Inventors: Peter Berdelle-Hilge, Constance (DE); Peter Enenkel, Constance (DE); Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/178,882

(22) Filed: Jul. 24, 2008

(65) Prior Publication Data

US 2009/0032369 A1 Feb. 5, 2009

(30) Foreign Application Priority Data

Jul. 24, 2007 (DE) ..... 10 2007 034 392

(51) Int. Cl.
*B65H 3/00* (2006.01)

(52) U.S. Cl. ..... 198/608; 198/604; 198/467.1; 414/798.2; 271/3.12; 271/34; 271/149; 271/150; 271/179

(58) Field of Classification Search ..... 198/604, 198/608, 467.1; 414/798.2; 271/3.12, 34, 271/149, 150, 179
See application file for complete search history.

(56) References Cited

U.S. PATENT DOCUMENTS 3,995,851 A * 12/1976 Casper ..... 271/179
4,299,379 A * 11/1981 Preston et al. ..... 271/3.01
4,328,962 A * 5/1982 Akers ..... 271/12
4,509,735 A * 4/1985 Kosner ..... 271/11
4,595,188 A * 6/1986 Wiley et al. ..... 271/4.01
4,884,795 A * 12/1989 Vander Syde ..... 271/34
5,310,043 A * 5/1994 Alcorn ..... 198/625
5,890,709 A * 4/1999 Phillips ..... 271/35
6,896,471 B2 * 5/2005 Svyatsky et al. ..... 414/421
7,025,347 B2 * 4/2006 Masui et al. ..... 271/241
7,367,445 B2 * 5/2008 Mazurek ..... 198/777

FOREIGN PATENT DOCUMENTS

DE 2628338 A1 1/1977
DE 19540992 A1 5/1997
DE 19540992 C2 3/1999
GB 1506111 4/1978
JP 20001114435 A 4/2001

* cited by examiner

*Primary Examiner*—Douglas A Hess

(57) ABSTRACT

Disclosed is a device for conveying a stack of flat objects, in particular a stack of mail items, in a conveyance direction. The conveyor device comprises a base face, a side wall, which is perpendicular to the base face, a base face conveyor facility let into the base face and a side wall conveyor facility let into the side wall. The side wall is divided into two partial side walls. The rear partial side wall—viewed in the conveyance direction—is offset outward in a direction perpendicular to the conveyance direction in relation to the front partial side wall. The side wall conveyor facility is let into the rear partial side wall. The base face conveyor facility is embodied to exert a force on the objects, which moves the objects toward the side wall conveyor facility.

12 Claims, 4 Drawing Sheets

DEVICE FOR CONVEYING A STACK OF FLAT OBJECTS

REFERENCE TO RELATED APPLICATIONS

This application claims the benefits of German application No. 10 2007 034 392.4 filed Jul. 24, 2007 and is incorporated by reference herein in its entirety.

FIELD OF INVENTION

The invention relates to a device for conveying a stack of flat objects, in particular a stack of mail items.

BACKGROUND OF THE INVENTION

A device with the features of the preamble of claim 1 is known from DE 19540992 C2. This discloses a device with a base face and a side wall. At least two rotatable spindle threads are let into the base face and at least one is let into the wall. The pitch of the spindle threads increases when viewed in the conveyance direction, with the result that the mail items are drawn upward.

SUMMARY OF INVENTION

The object of the invention is to provide a conveyor device with the features of the claims, which can transport flat objects efficiently, even if they adhere to one another.

The object is achieved by a conveyor device with the features of the claims. Advantageous embodiments are specified in the subclaims.

The conveyor device is embodied to transport a number of flat objects, which form a stack, in a conveyance direction.

The conveyor device comprises a base face, a side wall which is perpendicular to the base face, a base face conveyor facility let into the base face and a side wall conveyor facility.

The side wall is divided into two partial side walls. The rear partial side wall—viewed in the conveyance direction—is offset in a direction perpendicular to the conveyance direction in relation to the front partial side wall. The side wall conveyor facility is let into the rear partial side wall. Free space results between a putative extension of the front partial side wall in the conveyance direction and the rear partial side wall.

The base face conveyor facility is embodied to exert a force on the objects, moving the objects toward the side wall conveyor facility.

Because the side wall is divided into two partial side walls and the rear segment is offset in relation to the front one, free space results between the rear partial side wall and a putative extension of the front partial side wall. The flat objects are moved by the base face conveyor facility into this free space. The side wall conveyor facility operates into this free space. It is able to grip the objects in the free space and transport them.

The side wall conveyor facility preferably comprises support elements, which are located in the free space between the rear partial side wall and the putative extension in the conveyance direction of the front partial side wall. The force exerted by the base face conveyor facility moves the flat objects toward the support elements. This means that the support elements reach between the objects and support them and divide the stack into a number of sub-stacks.

The base face conveyor facility preferably comprises a spindle thread. The pitch or gap of this spindle thread increases—viewed in the conveyance direction—at least in one segment of the spindle thread. This means that the flat objects in the stack are moved apart, because the distance between two adjacent objects increases.

BRIEF DESCRIPTION OF THE DRAWINGS

The invention is described below with reference to an exemplary embodiment. In the drawings.

DETAILED DESCRIPTION OF INVENTION

In the exemplary embodiment the device is deployed to transport flat mail items and align them at two edges during transportation. These mail items function as the objects to be transported and are fed to a sorting unit in unaligned stacks, which originate from mailboxes and/or mail offices or from major mail customers for example. The aligned mail items are fed in a stack to a separating device in the sorting unit. During the feeding and separating processes the mail items stand on one edge, in other words they stand in an approximately vertical manner. It is possible that a number of mail items may adhere or stick to one another. The inventive device is thus arranged upstream in the exemplary embodiment before the separating facility.

Figure 1:
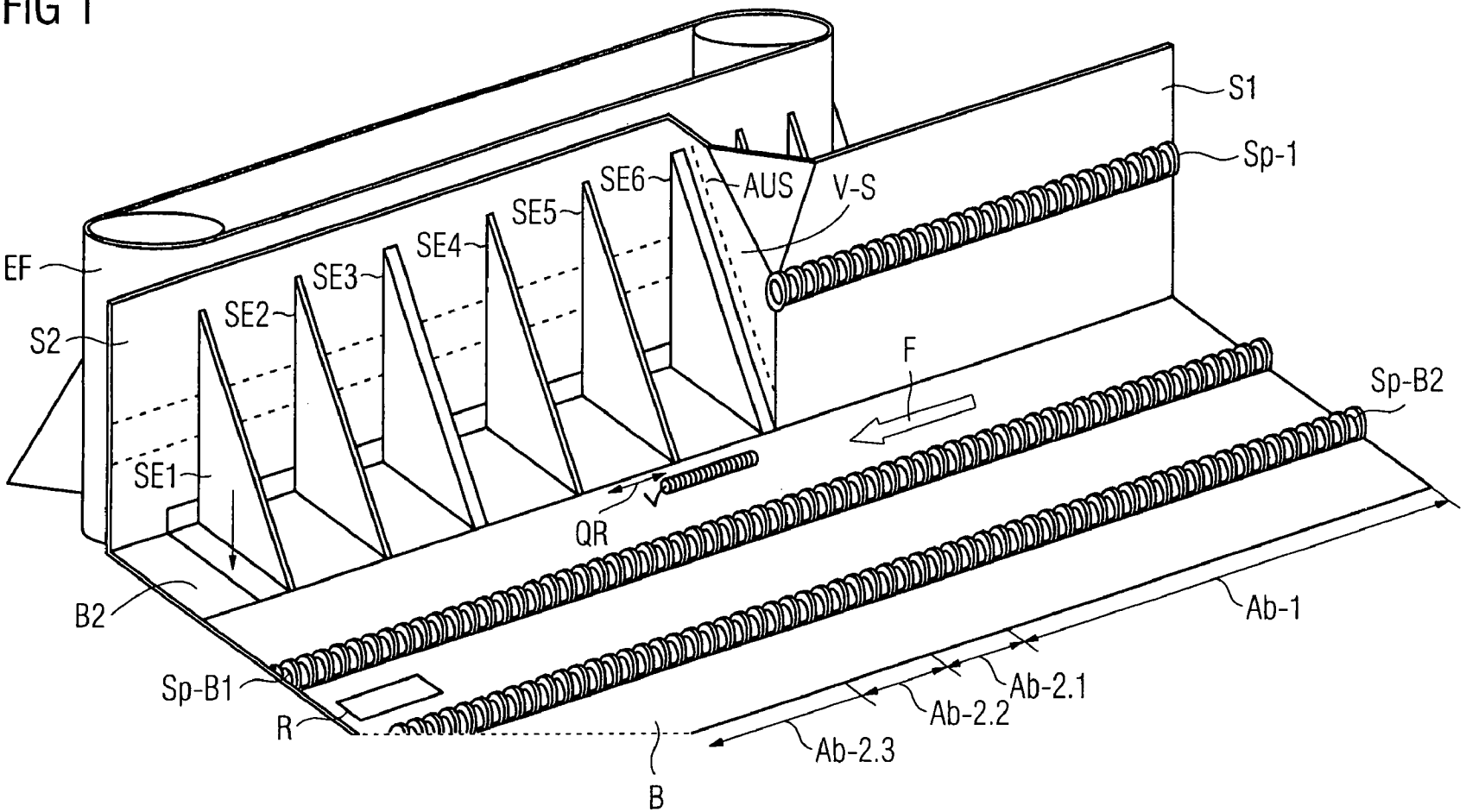
FIG. 1 shows a perspective view of the conveyor device.

FIG. 1 shows a perspective view of the conveyor device. In the example in FIG. 1 the mail items are conveyed from right to left in a conveyance direction F. The device comprises a base face B and a side wall. The side wall is divided into a front partial side wall S1—viewed in the conveyance direction F—and a rear partial side wall S2. The rear partial side wall S2—viewed in the conveyance direction F—is offset laterally outward in relation to the front partial side wall S1. Both partial side walls S1, S2 are perpendicular to the base face B. In one embodiment the base face B is horizontal and the partial side walls S1, S2 are vertical. It is however also possible for the base face B to be inclined in relation to the horizontal and the partial side walls S1, S2 to be inclined in relation to the vertical.

The base face B and both partial side walls S1, S2 function as two aligning faces. The flat mail items are aligned at these two aligning faces in such a manner that the two edges of the mail items adjacent to the aligning faces become parallel.

A spindle thread Sp1 is let into the front partial side wall S1 in the exemplary embodiment. A side wall conveyor facility is let into the rear partial side wall S2. In the exemplary embodiment this side wall conveyor facility comprises a series of vertical support elements SE-1, SE-2, . . . , an endless conveyor belt EF, a drive unit (not shown) to revolve the endless conveyor belt EF and a connection (also not shown) between the support elements SE-1, SE-2, . . . and the endless conveyor belt EF.

A cut-out Aus in the form of a longitudinal slot is let into the rear partial side wall S2. The connection between the support elements SE-1, SE-2, . . . and the endless conveyor belt EF passes through this cut-out Aus.

The front partial side wall S1 and the rear partial side wall S2 are connected to one another by a connecting wall V-S. There is a cut-out Aus in this connecting wall V-S. This cut-out is so large that the support elements SE-1, SE-2, . . . can be passed through said cut-out Aus, when the endless conveyor belt EF revolves.

Figure 2:
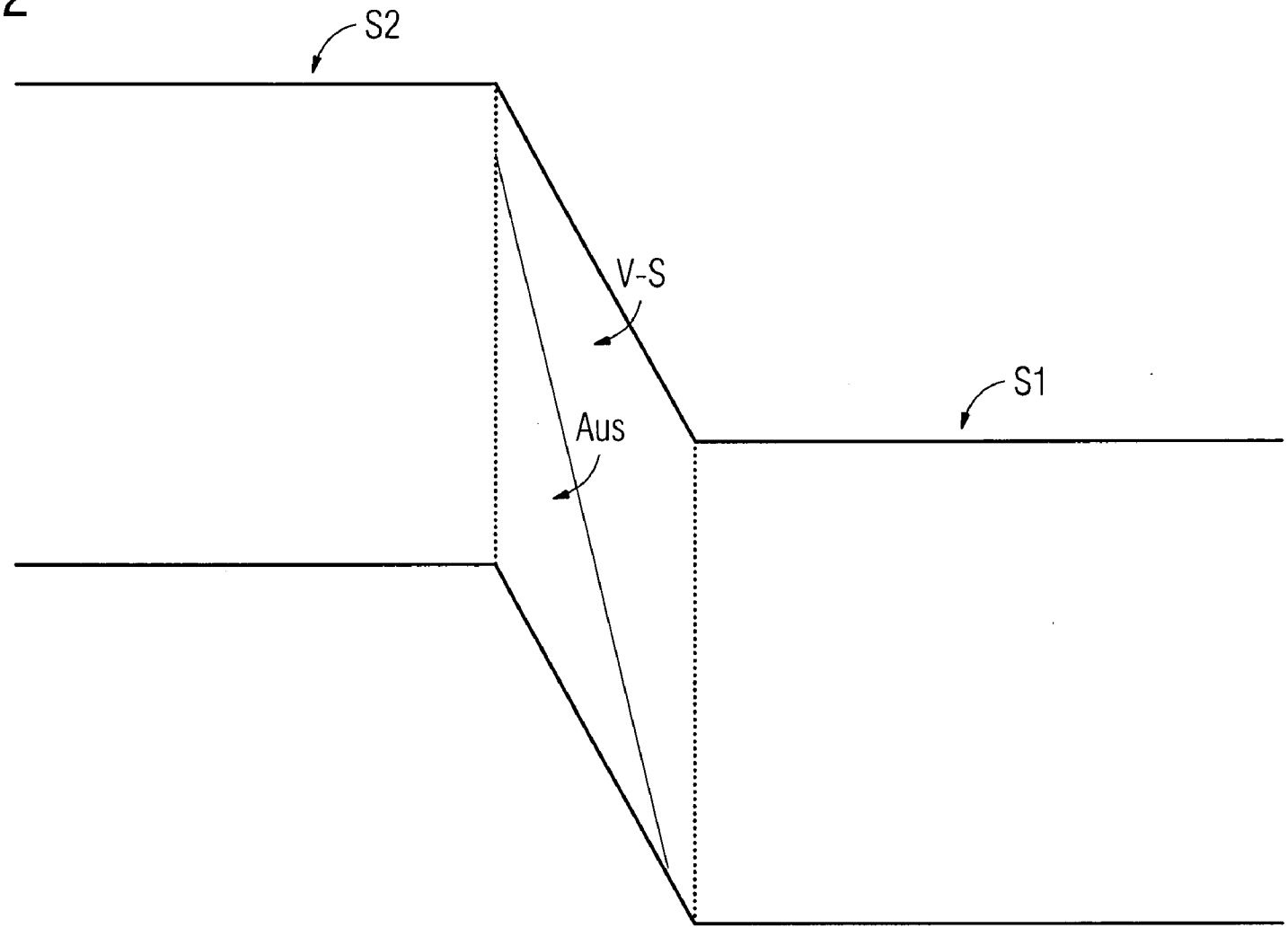
FIG. 2 shows a schematic diagram of the connecting wall between the partial side walls with the cut-out for the support elements.

FIG. 2 shows a schematic diagram of the connecting wall V-S between the partial side walls S1, S2 with the cut-out Aus for the support elements SE-1, SE-2, . . . . The support elements themselves are not shown in FIG. 2. In this exemplary embodiment the cut-out Aus is right-angled.

The vertical support elements SE-1, SE-2, . . . preferably extend respectively in a plane perpendicular to the base face B and perpendicular to the rear partial side wall S2. These planes are arranged parallel to one another. In the exemplary embodiment the support elements SE-1, SE-2, . . . are in the form of right-angled triangles. The one arm of such a triangle runs parallel to the rear partial side wall S2, the other arm runs parallel to the base face B. The vertical support elements SE-1, SE-2, . . . are located in their totality in the space between the putative extension of the front partial side wall S1 in the conveyance direction F and the rear partial side wall S2, as they transport mail items. The support elements therefore do not project beyond the putative extension.

Each right-angled triangle tapers upward. This brings about the following: when the mail items are moved toward the rear partial side wall S2, the triangle moves between the mail items with the hypotenuse as the front edge. The weight of the mail items enhances the effect that individual mail items are separated by the support elements SE-1, SE-2, . . . . The mail items are moved against the support elements by the force exerted by the spindle thread Sp-B in the base face B. Gravity draws the mail items downward. The oblique hypotenuses of the support elements stand the mail items back up again, as they are drawn downward.

The vertical support elements SE-1, SE-2, . . . can also have other forms. For example each support element can be in the form of a beam, running along the hypotenuse of a right-angled triangle shown in FIG. 1.

The side wall conveyor facility, which is let into the rear partial side wall S2, can also have different forms from those of the support elements. For example the side wall conveyor facility can have the form of a spindle thread or helix (a screw without a core). This helix is driven and rotates about a longitudinal axis, which extends in the conveyance direction F. The embodiment with the helix dispenses with the need to provide an endless conveyor belt EF and a cut-out Aus. But a helix does not convey and separate as efficiently as the vertical support elements SE-1, SE-2.

Two spindle threads Sp-B1, Sp-B2 are let into the base face B. These two spindle threads Sp-B1, Sp-B2 extend over both partial side walls S1, S2.

The two spindle threads Sp-B1, Sp-B2 function as the base face conveyor facility and are rotated by a drive unit. During rotation the two spindle threads Sp-B1, Sp-B2 exert a force on the mail items. This force moves the mail items toward the rear partial side wall S2 and therefore toward the support elements SE1, SE2, . . . .

The drive unit of the conveyor facility preferably moves the base face conveyor facility Sp-B1, Sp-B2 in synchronization with the support elements SE1, SE2, . . . . This means that no offset results in the conveyance direction F between the flanks of the two spindle threads Sp-B1, Sp-B2 and the support elements SE1, SE2 . . . . This means that the time period during which conveyance and displacement overlap is particularly short. Skewing of the conveyed mail items is prevented.

A vibration unit R is located between the two spindle threads Sp-B1, Sp-B2 in the exemplary embodiment. This vibration unit R is embodied to align the mail items, when they rest on the two spindle threads Sp-B1, Sp-B2 and are located over the vibration unit R. The vibration unit R brings about impulses. These impulses are preferably made up of two force components:

one component vertically upward counter to the force of gravity and one component perpendicular to the rotational axis of Sp-B1, Sp-B2 in a horizontal direction, i.e. toward the rear partial side wall S2.

In one embodiment a transverse vibration unit QR is located between the spindle thread Sp-B1 and the rear partial side wall S2. The transverse vibration unit QR vibrates the mail items through parallel to the rotational axis of the spindle thread Sp-B1, Sp-B2 and perpendicular to the surfaces of the mail items.

Figure 3:
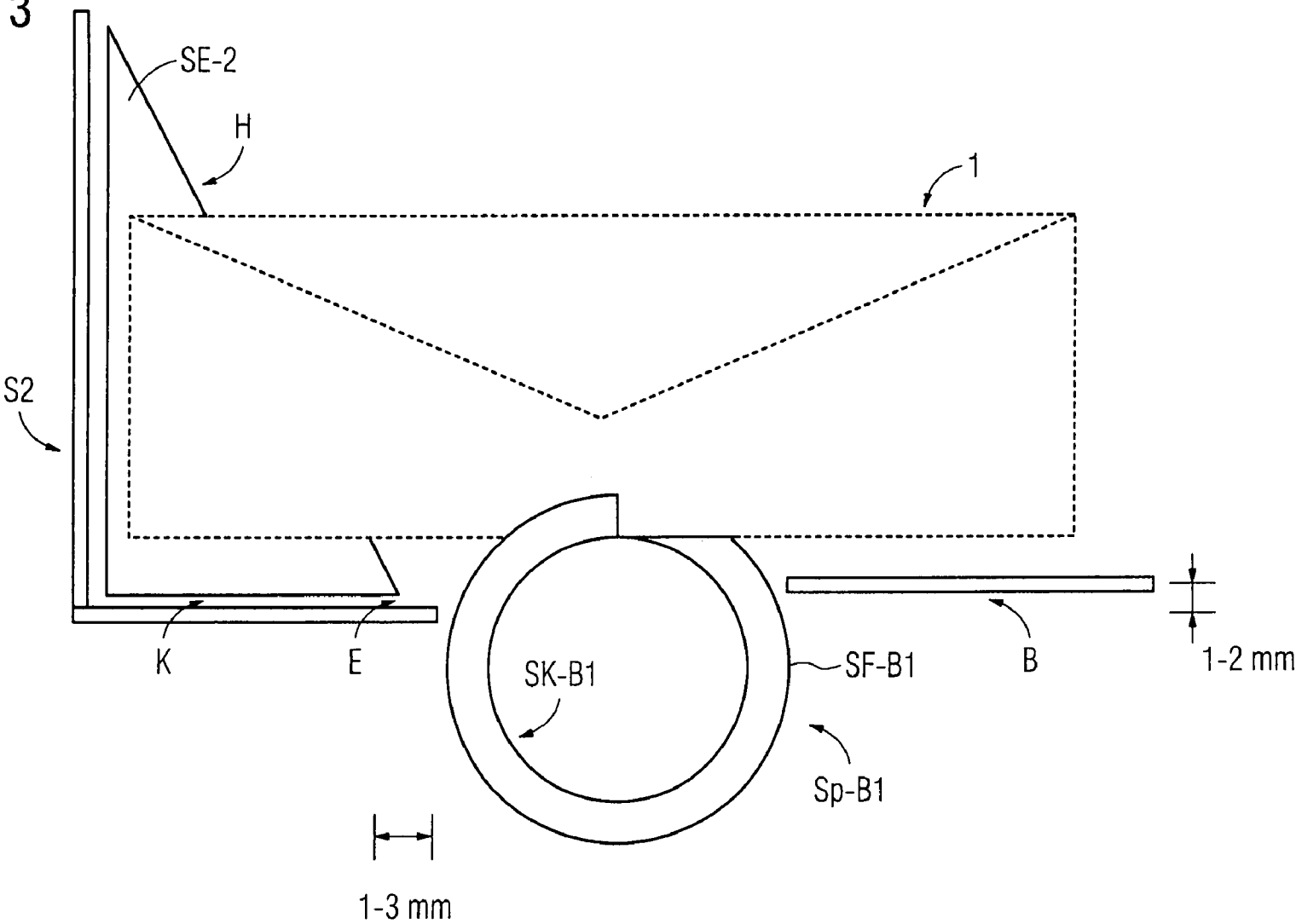
FIG. 3 shows a section through the conveyor facility in a plane perpendicular to the conveyance direction.

FIG. 3 shows a section through the conveyor facility F in a plane perpendicular to the conveyance direction F. It shows a flat mail item 1, a cross-section through the rear partial side wall S2, a cross-section through the base face B, a vertical support element SE-2 and a cross-section through the spindle thread Sp-B1.

It shows the spindle core SK-B1, which extends as a solid component over the entire length of the spindle thread Sp-B1 and the circumferential line of the spindle flank SF-B1. The flat mail item 1 rests on the spindle core SK-B1. The spindle flank SF-B1 engages between the mail item 1 and a preceding mail item (not shown).

The lower edge K of the support element SE2 with the corner E is located—viewed in the direction of gravity—below the lower edge K of the mail item 1. This is achieved by a corresponding arrangement of the support element SE2 and the spindle core SK-B1. The hypotenuse H is arranged so that the support element SE2 tapers—viewed in an upward direction counter to the force of gravity.

Between the corner E and the spindle thread Sp-B1 is a gap, whose component in the direction of the base face B is preferably between 1 mm and 3 mm.

As can also be seen in FIG. 3 in the exemplary embodiment the base face B is also divided into two partial base faces B1, B2. The partial base face B2 is located in the free space between the rear partial side wall S2 and the putative extension of the front partial side wall S1. The partial base face B1 is located in front of this free space and the partial side wall S1. The partial base face B1 is approximately 1 mm to 2 mm higher than the partial base face B2.

Three parameters of a spindle thread are defined below:

The flank width refers to the width of a rectangular tooth of the spindle thread, viewed in the longitudinal direction of the spindle thread.

The gap is the distance between two adjacent rectangular teeth of the spindle thread, measured at the edges facing one another The pitch is the distance between the center planes of two adjacent rectangular teeth.

In the case of a constant pitch, the pitch is equal to the sum of the flank width and the gap.

The three spindle threads Sp1, Sp-B1, Sp-B2 are rotated at constant and regular speed during operation of the aligning device. This means that the spindle flanks of all three spindle threads Sp1, Sp-B1, Sp-B2 move at a constant speed in the conveyance direction (in FIG. 1 from right to left).

In the exemplary embodiment the two spindle threads Sp-B1, Sp-B2 in the base face B are divided into five segments, which are described below and shown in FIG. 1.

The stack of flat mail items is placed on the base face in segment Ab-1.1. Both the gap and the pitch are constant over the entire region Ab-1.1. The gap constantly has value gap_1, the pitch constantly has value pitch_1.

In segment Ab-1.2 the pitch increases from value pitch_1 to value pitch_2. The pitch preferably increases continuously. The increase in pitch in segment Ab-1.2 is preferably achieved by wider spindle flanks with a constant gap gap_1.

In segment Ab-2.1 of spindle threads Sp-B1, Sp-B1 pitch and gap again remain unchanged. The pitch always has value pitch_2 and the gap always has value gap_1.

In segment Ab-2.2 the pitch remains constant at value pitch_2. The gap increases from value gap_1 to value gap_2.

In segment Ab.2.3 pitch and gap again remain unchanged. The pitch always has value pitch_2 and the gap always has value gap_2.

The increasing pitch and increasing gap mean that the mail items are moved apart during transportation in the conveyance direction F. The distance between two adjacent mail items increases. This facilitates alignment of the mail items at the two aligning faces B and S2.

The interaction of the two spindle threads Sp-B1, Sp-B2 and the support elements SE1, SE2, . . . causes the stack to be divided successively into a number of sub-stacks when it reaches the rear partial side wall S2.

Figure 4:
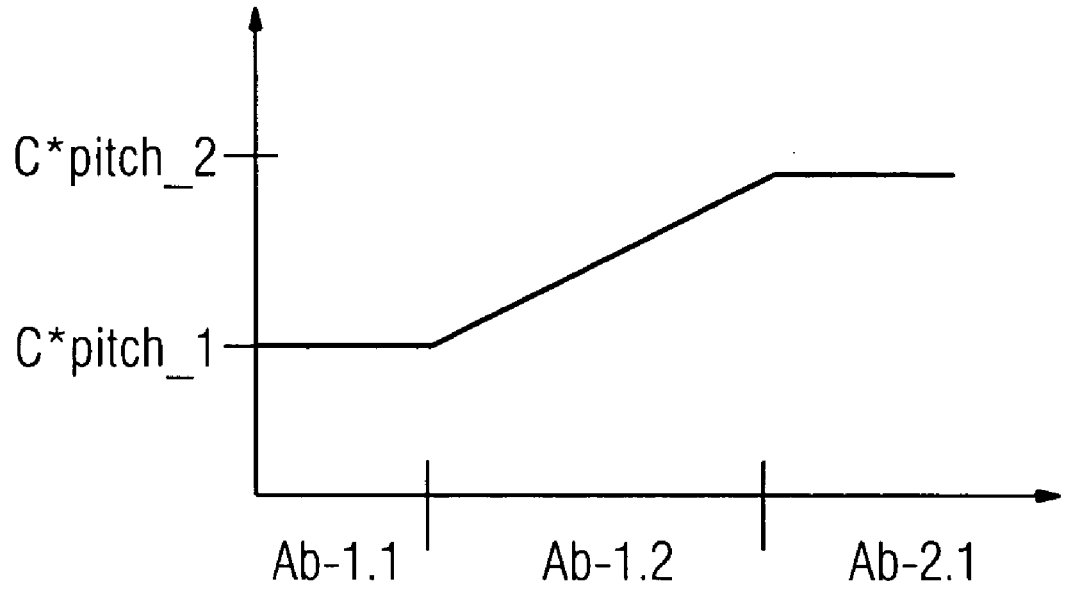
FIG. 4 shows a continuous and an abrupt transition from a smaller to a larger pitch.
Figure 4:
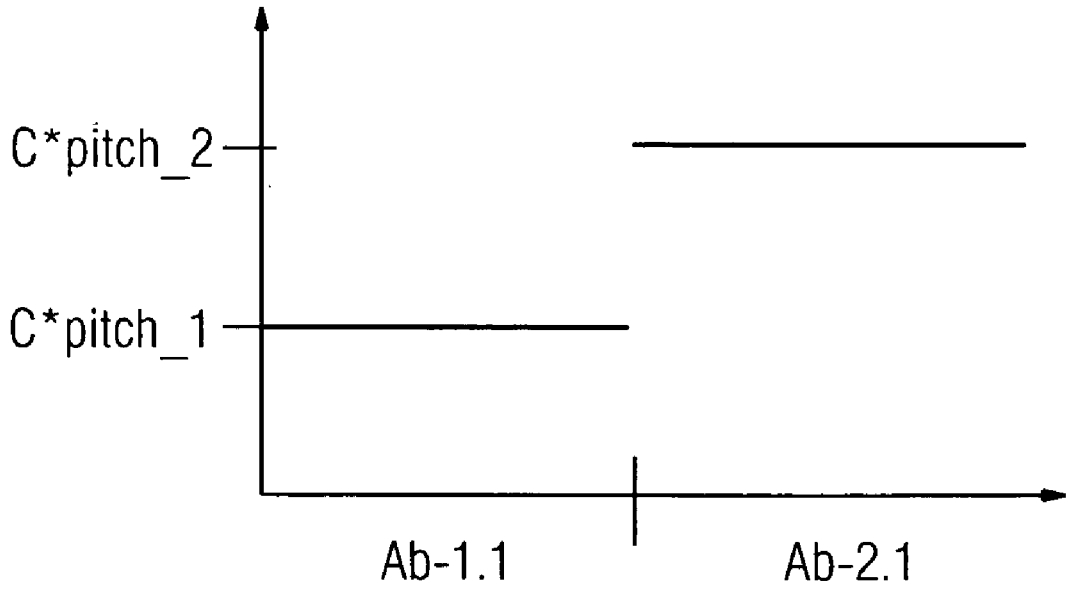

In the exemplary embodiment the transition from pitch_1 to pitch_2 is continuous and linear. The top part of FIG. 4 shows a continuous transition and the bottom part an abrupt transition from the smaller pitch pitch_1 to the larger pitch pitch_2. The x-axis shows the pitch as a function of the distance already covered in the conveyance direction F. The y-axis shows the conveyance speed reached. This conveyance speed is equal to the product of a factor C and the pitch.

The continuous transition results in more efficient separation of the mail items. A spindle thread with an abrupt transition is however easier to manufacture, because the spindle thread can be made from two parts, which are manufactured separately. The bottom part of FIG. 4 shows the abrupt transition. In the case of an abrupt transition the spindle thread has no segment Ab-1.2. Instead the segment Ab-1.1 is connected directly to the segment 2.1. The segment Ab-2.1 is correspondingly connected directly to the segment Ab-2.3.

The invention claimed is:

1. A conveyor device for conveying in a conveyance direction a plurality of flat objects that form a stack, comprising:

a base face;

a side wall arranged perpendicular to the base face;

a base face conveyor facility arranged into the base face; and a side wall conveyor facility arranged into the side wall, wherein the two conveyor facilities transport flat objects that stand on one edge on the base face in the conveyance direction and the base face conveyor facility exerts a force on the objects, moving the objects toward the side wall, and wherein the side wall is divided into a rear partial side wall and a front partial side wall, the rear partial side wall, viewed in the conveyance direction, is offset outward in a direction perpendicular to the conveyance direction in relation to the front partial side wall, and the side wall conveyor facility is arranged through the rear partial side wall and such that the force exerted by the base face conveyor facility moves the objects toward the side wall conveyor facility, wherein the side wall conveyor comprises a plurality of support elements and a drive unit to move the support elements, each support element extending in a plane perpendicular to the base face and perpendicular to the rear partial side wall and arranged such that the force exerted by the base face conveyor facility pushes the objects between the support elements; and the side wall conveyor facility has an endless conveyor belt, the drive unit revolves the endless conveyor belt, and the support elements connect to the drive unit.

2. The conveyor device as claimed in claim 1, further comprising a cut-out arranged in the rear partial side wall, through which a connection between the support elements and the endless conveyor belt passes.

3. The conveyor device as claimed in claim 2, wherein each support element has a lower edge arranged below the objects standing on the base face.

4. The conveyor device as claimed in claim 3, wherein the support elements are located entirely between the rear partial side wall and an extension in the conveyance direction of the front partial side wall.

5. The conveyor device as claimed in claim 4, wherein the side wall conveyor facility is a rotating spindle whose rotational axis runs in the conveyance direction.

6. The conveyor device as claimed in claim 5, wherein the base face conveyor facility comprises a spindle thread whose rotational axis runs parallel to the base face.

7. The conveyor device as claimed in claim 6, wherein the spindle thread comprises a segment, in which a gap between two spindle flanks of the spindle thread increases as viewed in the conveyance direction.

8. The conveyor device as claimed in claim 7, wherein the spindle thread comprises a segment whose thread pitch increases as viewed in the conveyance direction.

9. The conveyor device as claimed in claim 8, wherein the spindle thread is arranged through the base face so that a gap results between flat objects resting on the spindle core of the spindle thread and the base face.

10. The conveyor device as claimed in claim 9, wherein a vibration unit is arranged into the base face such that objects located on the base face conveyor facility vibrate through the conveyor facility.

11. The conveyor device as claimed in claim 9, wherein a further side wall conveyor facility is arranged into the front partial side wall.

12. The conveyor device as claimed in claim 11, wherein the further side wall conveyor facility is a spindle thread.

* * * * *